US011086250B2

(12) United States Patent
Tominaga et al.

(10) Patent No.: US 11,086,250 B2
(45) Date of Patent: Aug. 10, 2021

(54) IMAGE FORMING APPARATUS HAVING A FIRST CONTROL MODE FOR A FIRST MEDIUM AND A SECOND CONTROL MODE FOR A SECOND MEDIUM HAVING A LOWER TRANSFERABILITY THAN THE FIRST MEDIUM

(71) Applicant: FUJIFILM Business Innovation Corp., Tokyo (JP)

(72) Inventors: Yoshiyuki Tominaga, Kanagawa (JP); Masaaki Yamaura, Kanagawa (JP); Kotaro Araki, Kanagawa (JP); Ayumi Noguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/868,772

(22) Filed: May 7, 2020

(65) Prior Publication Data

US 2021/0080854 A1 Mar. 18, 2021

(30) Foreign Application Priority Data

Sep. 18, 2019 (JP) ..... JP2019-168981

(51) Int. Cl.
*G03G 15/06* (2006.01)

(52) U.S. Cl.
CPC ..... *G03G 15/065* (2013.01)

(58) Field of Classification Search
CPC ..... G03G 15/065; G03G 15/5029
See application file for complete search history.

(56) References Cited

U.S. PATENT DOCUMENTS

2003/0194251 A1* 10/2003 Maruyama ..... G03G 15/5029 399/389
2010/0067936 A1* 3/2010 Kitajima ..... G03G 15/5058 399/72
2010/0247120 A1 9/2010 Murata et al.
2013/0058665 A1* 3/2013 Ishida ..... G03G 15/065 399/29
2014/0341597 A1* 11/2014 Urayama ..... G03G 15/5054 399/27

FOREIGN PATENT DOCUMENTS

JP 11-295976 A 10/1999
JP 2011-007982 A 1/2011
JP 2016-161772 A 9/2016

* cited by examiner

*Primary Examiner* — Sandra Brase
(74) *Attorney, Agent, or Firm* — Sughrue Mion, PLLC

(57) ABSTRACT

An image forming apparatus includes an image carrier that carries an image, a developing unit that applies a developing voltage to develop an electrostatic latent image formed on the image carrier with a developer, a transfer unit that electrostatically transfers the image onto media of different types, and a development controller that controls a developing operation of the developing unit. The development controller has a first control mode for a first medium, and a second control mode for a second medium having a lower transferability than the first medium. In the first control mode, the developing unit applies the developing voltage according to a first developing condition. In the second control mode, the developing unit applies the developing voltage according to a second developing condition in which a developing property is reduced as compared with the first developing condition.

20 Claims, 14 Drawing Sheets

PLAIN PAPER

EMBOSSED PAPER/ROUGH PAPER

DEVELOPING OPERATION
IN SECOND IMAGE FORMING MODE

DEVELOPING OPERATION
IN FIRST IMAGE FORMING MODE

TRANSFER OPERATION
IN SECOND IMAGE FORMING MODE

TRANSFER OPERATION
IN FIRST IMAGE FORMING MODE

IMAGE FORMING APPARATUS HAVING A FIRST CONTROL MODE FOR A FIRST MEDIUM AND A SECOND CONTROL MODE FOR A SECOND MEDIUM HAVING A LOWER TRANSFERABILITY THAN THE FIRST MEDIUM

CROSS-REFERENCE TO RELATED APPLICATIONS

This application is based on and claims priority under 35 USC 119 from Japanese Patent Application No. 2019-168981 filed Sep. 18, 2019.

BACKGROUND

1. Technical Field

The present disclosure relates to an image forming apparatus.

2. Related Art

As image forming apparatuses of a related art, for example, those described in JP-A-2016-161772 (see DETAILED DESCRIPTION and FIG. 4), JP-A-2011-007982 (see DETAILED DESCRIPTION, and FIG. 4), and JP-A-11-295976 (see Embodiments of the Invention and FIG. 6) are already known.

JP-A-2016-161772 discloses an image forming apparatus having a plain paper printing mode and a thick paper printing mode with a slow process speed. The image forming apparatus sets a peak-to-peak voltage of an AC component of a developing bias in the thick paper printing mode to be lower than that in the plain paper printing mode.

JP-A-2011-007982 discloses an image forming apparatus that performs an image forming operation in a state in which application of an AC component of a developing voltage to a developing device is stopped based on information on a stop time of the developing device in order to prevent a failure such as fogging during an image forming operation that starts after the image forming apparatus is stopped for a predetermined time.

JP-A-11-295976 discloses a technique for reading an accumulated image forming time of forming an image having a preset image density in order to prevent deteriorated toner from accumulating in a developing device when a toner image forming amount is small, and when a threshold value is exceeded, discharging (replacing) toner to keep a toner in the developing device in a good state.

SUMMARY

Aspects of non-limiting embodiments of the present disclosure relate to an image forming apparatus capable of keeping a good transferability of an image carried by an image carrier onto a medium in interest even if the medium in interest is of a type having a low transferability in a mode in which images are transferred to media of different types, as compared with a case where the same developing conditions are adopted for different types of media.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image carrier configured to carry an image; a developing unit including a developer carrying unit that faces the image carrier, the developing unit being configured to apply a developing voltage in which an AC component is superimposed on a DC component between the image carrier and the developer carrying unit so as to develop an electrostatic latent image formed on the image carrier with a developer carried by the developer carrying unit; a transfer unit configured to electrostatically transfer the image, which is carried on the image carrier and developed by the developing unit, onto media of different types; and a development controller configured to control a developing operation of the developing unit, in which the development controller has a first control mode for a first medium, and a second control mode for a second medium having a lower transferability than the first medium, in the first control mode, the developing unit applies the developing voltage according to a predetermined first developing condition, and in the second control mode, the developing unit applies the developing voltage according to a second developing condition in which a developing property is reduced as compared with the first developing condition.

BRIEF DESCRIPTION OF THE DRAWINGS

Exemplary embodiment(s) of the present disclosure will be described in detail based on the following figures, wherein.

DETAILED DESCRIPTION

Outline of Exemplary Embodiment

Figure 1:
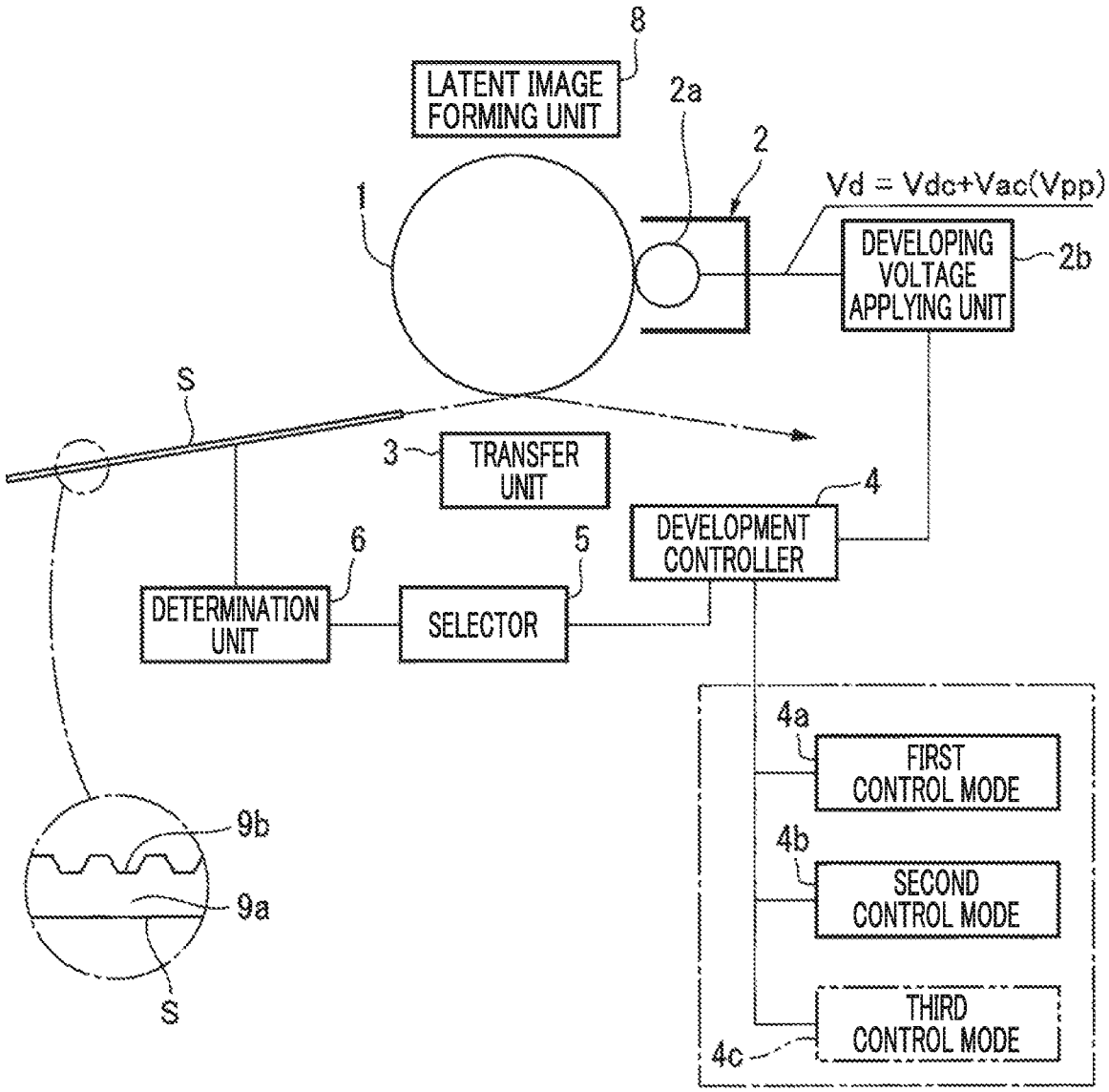
FIG. 1 is a diagram showing an outline of an image forming apparatus according to an exemplary embodiment of the present disclosure.

FIG. 1 shows an outline of an image forming apparatus according to an exemplary embodiment of the present disclosure.

In FIG. 1, the image forming apparatus includes an image carrier 1, a developing unit 2, a transfer unit 3, and a development controller 4. The image carrier 1 carries an image. The developing unit 2 includes a developer carrying unit 2*a* that faces the image carrier 1. The developing unit 2 applies a developing voltage Vd in which an AC component Vac is superimposed on a DC component Vdc between the image carrier 1 and the developer carrying unit 2*a* so as to develop an electrostatic latent image formed on the image carrier 1 with a developer carried by the developer carrying unit 2*a*. The transfer unit 3 electrostatically transfers the image, which is carried on the image carrier 1 and developed by the developing unit 2, onto media S of different types. The development controller 4 controls a developing operation of the developing unit 2. The development controller 4 has a first control mode 4*a* for a first medium and a second control mode 4*b* for a second medium having a lower transferability than the first medium. In the first control mode 4*a*, the developing unit 2 applies the developing voltage Vd according to a predetermined first developing condition. In the second control mode 4*b*, the developing unit 2 applies the developing voltage Vd according to a second developing condition in which a developing property is reduced as compared with the first developing condition.

In FIG. 1, reference numeral 8 denotes a latent image forming unit that forms the electrostatic latent image on the image carrier 1.

In such a technique, the image carrier 1 may be any of units that are capable of forming an electrostatic latent image, such as a photoconductor or a dielectric. The image carrier 1 may have any form such as a drum shape or a belt shape.

The latent image forming unit 8 broadly includes a section that forms the electrostatic latent image on the image carrier 1, and when the image carrier 1 is, for example, the photoconductor or the dielectric, there is a mode including a charger that charges the image carrier 1, and a latent image writing unit that writes the electrostatic latent image on the image carrier 1 charged by the charger.

Furthermore, the developing unit 2 is not limited to those using a two-component developer but may be those using a single-component developer, as long as the developing unit 2 has the developer carrying unit 2*a* and a developing voltage applying unit 2*b* that applies the developing voltage Vd in which the AC component Vac is superimposed on the DC component Vdc.

The transfer unit 3 broadly includes a section that transfers an image to the medium S, and includes not only a direct transfer type that directly transfers the image on the image carrier 1 to the medium but also an intermediate transfer type using an intermediate transfer body. And the intermediate transfer type includes a primary transfer unit that primarily transfers the image on the image carrier 1 to the intermediate transfer body and a secondary transfer unit that secondarily transfers the image primarily transferred on the intermediate transfer body to the medium S.

The development controller 4 may only have the first control mode 4*a* for the first medium and the second control mode 4*b* for the second medium having a lower transferability than the first medium. In the second control mode 4*b*, the developing unit 2 may apply the developing voltage Vd according to the second developing condition in which the developing property is reduced as compared with the first developing condition. Here, the second developing condition in which the developing property is reduced may be selected so that a developing parameter of the AC component Vac of the developing voltage Vd (peak-to-peak voltage Vpp or frequency Vf) is reduced as compared with the first developing condition.

In the present example, a technical background in which the second control mode 4*b* is provided separately from the first control mode 4*a* is supplemented as follows. That is, although an external additive is added to a toner contained in the developer in consideration of a releasability, a chargeability, and the like, if the toner stays in the developing unit 2 for a long time, the external additive is embedded in the toner surface to become a deteriorated toner. Accordingly, this type of deteriorated toner has a poor transferability to the medium S, and in particular, in consideration of the fact that a sensitivity to the deterioration of an image quality such as a white spot is high in a medium having a low transferability (so-called embossed paper, rough paper, or the like), it is intended to adopt a developing condition in which the deteriorated toner is not included as much as possible in the image to be transferred when the medium having the low transferability is used.

Next, a typical aspect of the image forming apparatus according to the present exemplary embodiment will be described.

Here, as a typical aspect of the medium S having the low transferability, the second medium may be lower in information on surface smoothness than the first medium. In the present example, the information on the surface smoothness is used as an index for distinguishing whether or not a medium is the medium S having the low transferability. The information on the surface smoothness is an index for distinguishing whether or not the medium is a medium S (so-called embossed paper) having an embossed surface (that is, raised or recessed portion or embossment) 9*b* on a medium body 9*a*. The term "information on surface smoothness" used herein is not limited to the surface smoothness according to the JIS standard or the like. The term "information on surface smoothness" broadly includes a ratio of a depth of the embossment 9*b* to a thickness of the medium body 9*a*, as long as a smoothness degree of the surface portion is used as an index.

As another typical aspect of the medium S having the low transferability, the second medium may be lower in information on density than the first medium. In the present example, information on density is used as an index for distinguishing whether or not the medium is the medium S having the low transferability, and is an index for distinguishing whether or not the medium is a medium having a rough texture and a rough touch (so-called rough paper). The term "information on density" used herein is not limited to the case of directly expressing the density, but broadly includes indirect expressions, and information on air permeability, basis weight, ream weight, and the like are widely adopted.

In addition, as a typical aspect of the development controller, a selector 5 is provided that selects the first control mode 4*a* and the second control mode 4*b* based on a type of the medium S. In the present example, the selector 5 based on the type of the medium S is used to select the first and second control modes 4*a* and 4*b*. Here, for the "type of the medium S", a threshold value may be determined in advance for a parameter for distinguishing the medium S having the low transferability, or a selection mode (for example, embossment mode) for specifying the type of the medium S may be determined, for example, without determining a specific threshold value.

In the present example, as an example of a configuration of a selector 5, the selector selects the first control mode 4*a* when the medium S does not belong to the second medium, and selects the second control mode 4*b* when the medium S belongs to the second medium. In the present example, the first or second control mode is selected depending on whether or not the medium belongs to the second medium.

Another example of the configuration of the selector 5 includes a determination unit 6 that determines whether or not the medium S belongs to the second medium, and the selector 5 selects the first control mode 4*a* or the second control mode 4*b* based on determination signals from the determination unit 6. In the present example, the first or second control mode 4*a* or 4*b* is selected based on the determination signals of the determination unit 6 by using the determination unit 6 which determines whether or not the medium is the second medium.

As a typical aspect of the first or second control mode 4*a* or 4*b*, the first control mode 4*a* and the second control mode 4*b* use the peak-to-peak voltage Vpp of the AC component Vac of the developing voltage Vd as the developing condition, and control the peak-to-peak voltage Vpp in the second control mode 4*b* to be lower than the peak-to-peak voltage Vpp in the first control mode 4*a*. In the present example, the peak-to-peak voltage Vpp of the AC component Vac of the developing voltage Vd is to be controlled as the developing condition.

Furthermore, as an aspect of the second control mode 4*b*, the DC component Vdc of the developing voltage Vd may be considered to be controlled in addition to the peak-to-peak voltage Vpp of the AC component Vac of the developing voltage Vd. The present example is an aspect in which the DC component Vdc is also controlled as the developing condition in addition to the peak-to-peak voltage Vpp of the AC component Vac of the developing voltage Vd, and is effective in ensuring density quality of the image developed on the image carrier 1 by controlling the DC component Vdc.

Further, as an aspect of the development controller 4, the development controller 4 executes the first control mode 4*a* when forming an image that is not formed on the medium S. In the present example, the "image that is not formed on the medium S" refers to a process control image or the like formed in an inter-image region. When the second control mode 4*b* is executed, a deteriorated developer is not used for development, so that there is a possibility that the deteriorated developer stays in the developing unit 2. However, when developing an image that is not formed on the medium S, the image quality is not limited as compared with a case where the image is formed on the medium S, and therefore, a discharge of the deteriorated developer is prioritized.

Further, as an aspect of the development controller 4, the development controller 4 includes a third control mode 4*c* that controls the peak-to-peak voltage Vpp of the AC component Vac of the developing voltage Vd to be higher than the peak-to-peak voltage Vpp in the first control mode 4*a*, and executes the third control mode 4*c* when forming an image that is not formed on the medium S. The present example includes the third control mode 4*c* in addition to the first and second control modes 4*a* and 4*b*, and when the discharge of the deteriorated developer from the developing unit 2 is prioritized, the third control mode 4*c* is effectively used, and the discharge amount of the deteriorated developer is further increased as compared with a case where the first control mode 4*a* is used.

Further, as an aspect of the image forming apparatus according to the present exemplary embodiment, the image forming apparatus includes a transfer controller not shown that performs control such that the transfer condition of the transfer unit 3 is changed when the development controller 4 executes the first control mode 4*a* or the second control mode 4*b*. In the present example, a transfer condition suitable for the type of the medium S is implemented in addition to a development control by the development controller 4.

Hereinafter, the present disclosure will be described in more detail based on the exemplary embodiments shown in the accompanying figures.

Exemplary Embodiment 1

Figure 2:
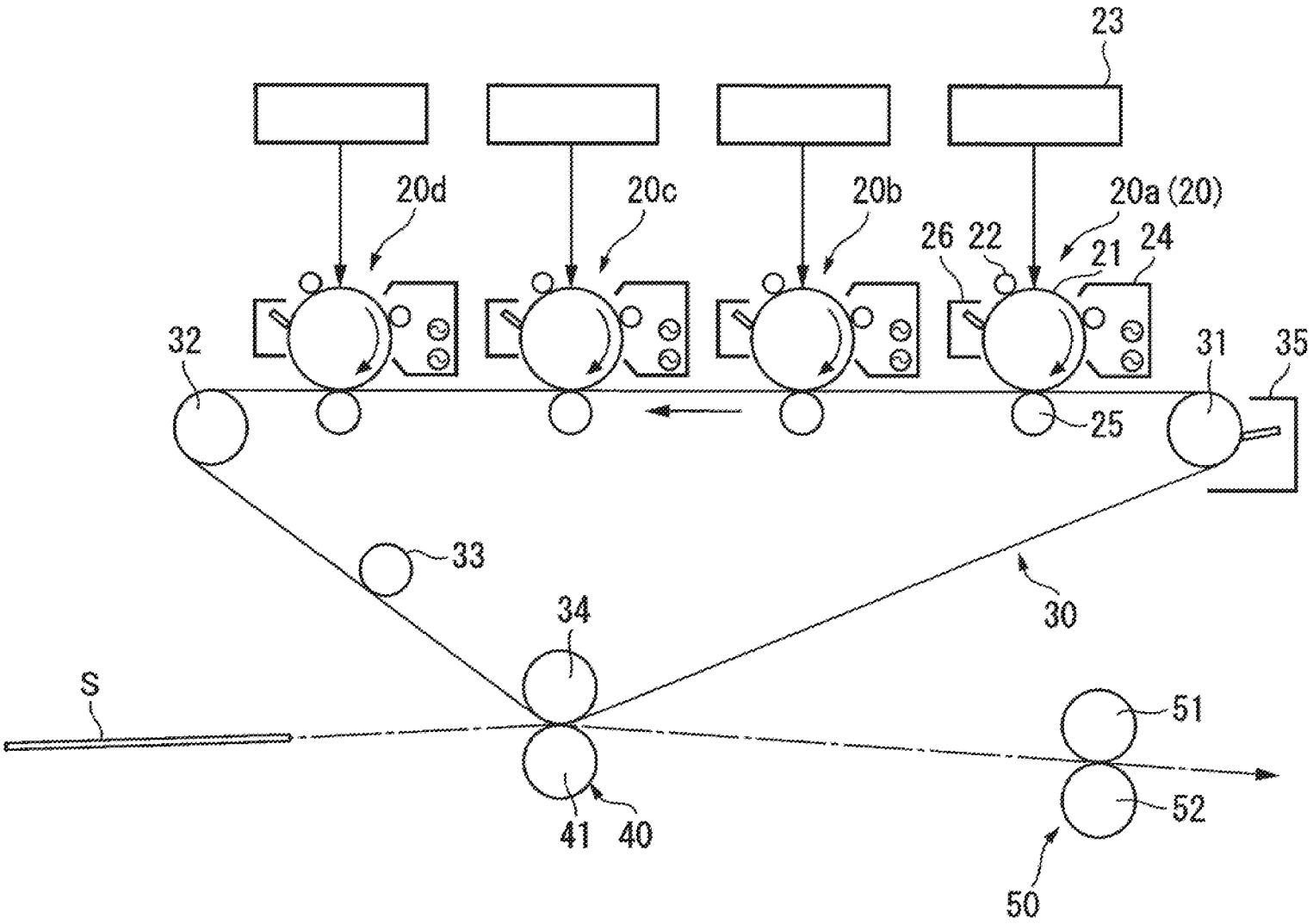
FIG. 2 is a diagram showing an overall configuration of the image forming apparatus according to an exemplary embodiment 1.

FIG. 2 shows an overall configuration of an image forming apparatus according to an exemplary embodiment 1.

—Overall Configuration of Image Forming Apparatus—

In the drawing, the image forming apparatus includes image forming units 20 (specifically, 20*a* to 20*d*), a belt-shaped intermediate transfer body 30, a secondary transfer device (collective transfer device) 40, and a fixing device 50, in an apparatus housing (not shown). The image forming units 20 form image of plural color components (yellow, magenta, cyan, and black in the present exemplary embodiment). The intermediate transfer body 30 sequentially transfers (primarily transfers) and carries the images of the color component formed by the image forming units 20. The secondary transfer device 40 secondarily transfers (collectively transfers) the images of the color components transferred on the intermediate transfer body 30 onto a sheet S that is an example of a medium. The fixing device 50 fixes the image secondarily transferred onto the sheet S.

<Image Forming Unit>

In the present exemplary embodiment, each of the image forming unit 20 (20*a* to 20*d*) has a drum-shaped photoconductor 21, and around each photoconductor 21, there are provided a charging device 22 for charging the photoconductor 21, an exposure device 23 such as a laser scanning device for writing an electrostatic latent image on the charged photoconductor 21, a developing device 24 for developing the electrostatic latent image written on the photoconductor 21 with each color component toner, a primary transfer device 25 such as a transfer roller for transferring a toner image on the photoconductor 21 to the intermediate transfer body 30, and a cleaning device 26 for cleaning residual toner on the photoconductor 21.

<Intermediate Transfer Body>

The intermediate transfer body 30 is stretched over plural tension rollers 31 to 34 (four rollers in the present exemplary embodiment). The tension roller 31 is used, for example, as a driving roller driven by a driving motor (not shown in the figure), and the intermediate transfer body 30 is circulated and moved by the driving roller. Further, all of the tension rollers 32 to 34 are used as driven rollers, and the tension roller 33 functions as a tension roller for applying a predetermined tension to the intermediate transfer body 30. Further, an intermediate transfer body cleaning device 35 for removing residual toner on the intermediate transfer body 30 after the secondary transfer is provided at a portion of the peripheral surface of the intermediate transfer body 30 facing the tension roller 31.

<Secondary Transfer Device (Collective Transfer Device)>

Further, the secondary transfer device (collective transfer device) 40 is arranged such that a transfer roller 41 is in contact with a surface of the intermediate transfer body 30 at a portion of the periphery of the intermediate transfer body 30 facing a tension roller 34, and a predetermined transfer electric field is applied between the transfer roller 41 and the tension roller 34 using the tension roller 34 as a counter electrode.

Figure 3:
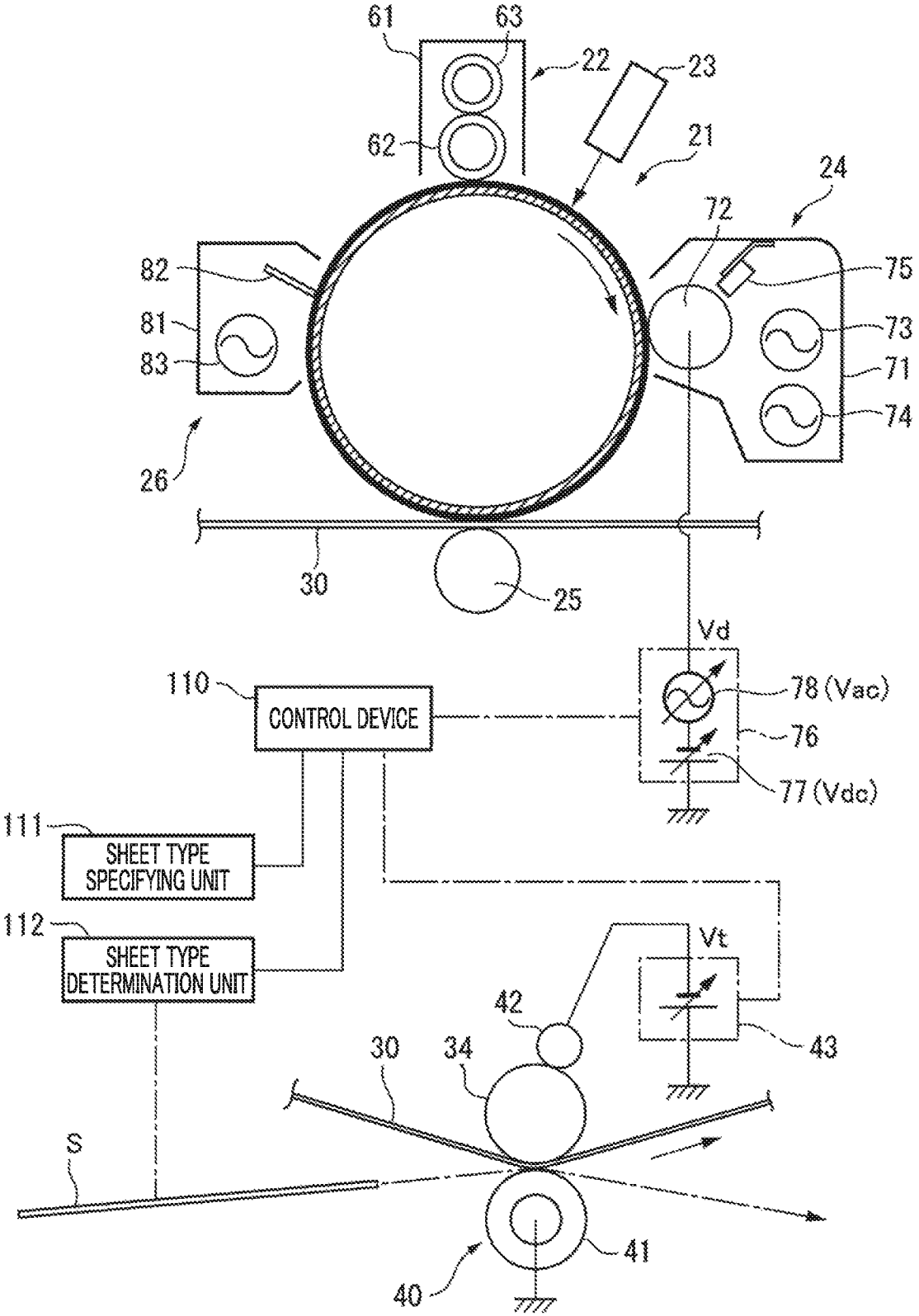
FIG. 3 is a diagram showing an example of the configuration around an image forming unit and a secondary transfer device that are used in the exemplary embodiment 1 and a control system thereof.

In the present example, the transfer roller 41 has a configuration in which a metal shaft is coated with an elastic layer formed by mixing urethane foam rubber or EPDM with carbon black or the like, and the metal shaft is installed, while a power supply roller 42 is disposed in contact with the tension roller 34 that is a counter electrode, as shown in FIG. 3, and a power supply for transfer 43 for applying a transfer voltage Vt is connected to the power supply roller 42.

<Fixing Device>

The fixing device 50 includes, for example, a heating fixing roller 51 that can be driven to rotate and a pressure fixing roller 52. The heating fixing roller 51 comes into contact with an image carrying surface of the sheet S. The pressure fixing roller 52 faces the heating fixing roller 51 and is in pressure contact with the heating fixing roller 51. The pressure fixing roller 52 rotates following the heating fixing roller 51. The fixing device 50 passes the image carried on the sheet S through a transfer region between the fixing rollers 51 and 52 to heat, press, and fix the image.

—Example of Configuration of Charging Device—

In the present exemplary embodiment, as shown in FIG. 3, the charging device 22 has a charging housing 61 having an opening at a portion facing the photoconductor 21, and a charging roller 62 serving as a charging member that contacts the surface of the photoconductor 21 is disposed in the charging housing 61, and a cleaning roller 63 for cleaning the charging roller 62 is disposed.

Here, the charging roller 62 has, for example, a conductive metal shaft, and a charging layer is formed at a position other than both end supporting portions of the shaft, but is not limited to this, and may be appropriately changed in design.

On the other hand, the cleaning roller 63 has, for example, a conductive metal shaft, and a sponge layer is formed by spirally winding, for example, a sponge material as a cleaning material around the shaft. The sponge layer of this kind is selected from those made of a foamable resin or rubber such as polyurethane, polyethylene, polyamide or polypropylene. The configuration of the cleaning roller 63 is not limited to this, and the design may be appropriately changed.

—Example of Configuration of Developing Device—

The developing device 24 has a developing container 71 in which a portion facing the photoconductor 21 is opened to accommodate a developer containing, for example, toner and carrier, a developing roller 72 capable of carrying the developer is arranged at a portion facing an opening of the developing container 71, agitation transport members 73 and 74 capable of circulating and transporting the developer by agitating the developer are arranged on a back side of the developing roller 72 of the developing container 71, and further, a layer thickness regulating member 75 for regulating a layer thickness of the developer that may be carried by the developing roller 72 is arranged at a portion facing the developing roller 72.

In the present example, a developing power supply 76 is connected to the developing roller 72. The developing power supply 76 is, for example, a series connection between a DC power supply 77 and an AC power supply 78, any power supply 77, 78 is also configured to be variably adjustable. Therefore, the developing roller 72 is configured to be applied the developing voltage Vd in which the AC component Vac is superimposed on the DC component Vdc.

In addition to the toner and the carrier, various external additives including zinc stearate (ZnSt) and silica are added to the developer of the present example. Here, ZnSt is largely added in an appropriate amount as a lubricating adjusting agent, and silica is added in an appropriate amount as a charging adjusting agent.

—Example of Configuration of Cleaning Device—

As shown in FIG. 3, the cleaning device 26 has a cleaning container 81 in which a portion facing the photoconductor 21 is opened, a plate-shaped cleaning member 82 that elastically contacts the photoconductor 21 is disposed at a portion facing an opening along a longitudinal direction of the cleaning container 81, and a transport member 83 that transports residual toner or the like scraped by the cleaning member 82 along the longitudinal direction of the cleaning container 81 and discharges the residual toner or the like to an outside is disposed in the cleaning container 81.

—Sheet Type—

In the present exemplary embodiment, not only plain paper whose surface smoothness and density belong to a predetermined range but also special paper such as embossed paper and rough paper are used as the sheet S in a mixed manner.

In this example, as shown in FIG. 3, a sheet type specifying unit 111 that specifies a sheet type and a sheet type determination unit 112 that determines the sheet type are provided.

<Sheet Type Specifying Unit>

The "sheet type specifying unit 111" described herein may be configured as follow. That is, for example, based on information on surface smoothness of the sheet S and information on the density of the sheet S, a sheet type table is prepared in the RAM of a control device 110 (which will be described later) in advance. Usable types of sheets are registered in the sheet type table. A user searches the sheet type table for a type of a sheet S that he/she wants to use and specifies the type of the sheet S. The sheet type table may be updated so that the unregistered sheet S may be sequentially registered.

<Sheet Type Determination Unit>

In the present example, in a case where the sheet type determination unit 112 determines whether or not the sheet S to be used is embossed paper, the "sheet type determination unit 112" may be configured as follows. That is, an optical detector (not shown) capable of detecting information on the surface smoothness of the sheet S is provided at a position facing a sheet transport path surface, the surface smoothness of the sheet S is determined based on the amount of light reflected from the surface of the sheet S so as to determine whether or not the sheet S belongs to the embossed paper. In a case where the sheet type determination unit 112 determines whether or not the sheet S to be used is rough paper, the "sheet type determination unit 112" may be configured as follows. That is, a measuring instrument (not shown) capable of measuring information on the density of the sheet S is provided, and it is determined whether or not the sheet S belongs to rough paper based on a measurement result obtained by the measuring instrument. Further, in a case where plural sheet supply containers (not shown in the figure) are provided and, for example, an accommodation location of the embossed paper or the rough paper is a predetermined sheet supply container, a position detector for detecting that the sheet S is supplied from the sheet supply container accommodating the embossed paper or the like may be provided, and it may be determined whether or not the sheet S is the embossed paper based on the detection result from the position detector.

—Factors of Deterioration of Image Quality for Embossed Paper/Rough Paper—

In the present exemplary embodiment, not only the plain paper but also special paper such as the embossed paper and the rough paper are used as the sheet S in a mixed manner. However, in a case of using the embossed paper or rough paper, when an image forming process is executed in the same image forming mode as that of the plain paper, it is confirmed that a phenomenon of a quality deterioration of a transferred image in which a part of the transferred image becomes a white spot.

When inventors of the present disclosure examined a factor of such a quality deterioration of the transferred image, it is found that the deteriorated toner contained in the deteriorated developer staying in the developing device 24 may be a factor.

Figure 4A:
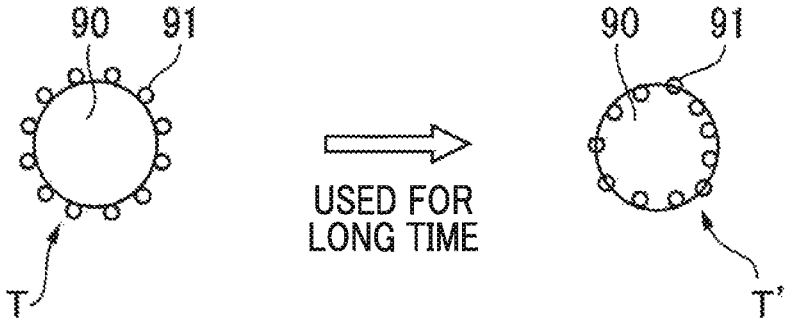
FIG. 4A is a diagram showing a deteriorated state of a toner that has been used for a long time.

More specifically, as shown in FIG. 4A, toner T included in the developer is obtained by adding an external additive 91 (for example, zinc stearate, silica, or the like) for adjusting the chargeability and lubricity to a surface of toner particles 90 such as a resin binder, a pigment, and a wax. At this time, in the new toner T, the external additive 91 is carried on the surface of the toner particles 90. However when the external additive 91 stays in the developing device 24 for a long time, the external additive 91 gradually becomes embedded in the toner particles 90, and when a degree of the embedment becomes remarkable, the chargeability and the like by the external additive 91 become unstable, and it leads to a situation in which, for example, the new toner T changes to a deteriorated toner T' having a low chargeability.

Therefore, it is presumed that the toner T having normal chargeability and the like and the deteriorated toner T' are mixed in the developing device 24.

Figure 4B:
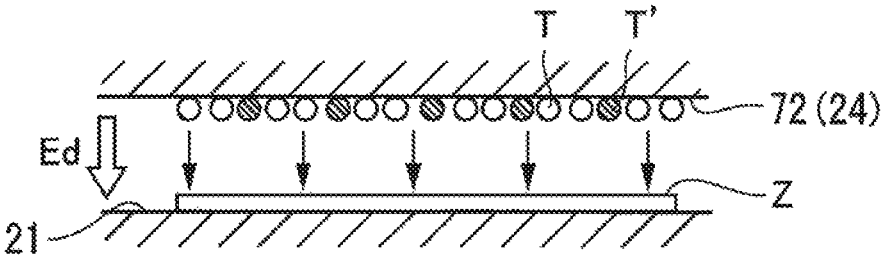
FIG. 4B is a diagram schematically showing a developing operation in a developing region of a developing device.

Further, as shown in FIG. 4B, since the AC component Vac superimposed by the DC component Vdc is applied to the developing roller 72 of the developing device 24, a developing electric field Ed works between the developing roller 72 and the photoconductor 21, the toner T carried on the developing roller 72 through the carrier flies toward the electrostatic latent image on the photoconductor 21 to visualize the electrostatic latent image. At this time, when the developing electric field Ed is increased, the developing property to the toner is activated by that much, and not only the normal toner T but also the deteriorated toner T' tend to be used for development and fly.

Figure 4C:
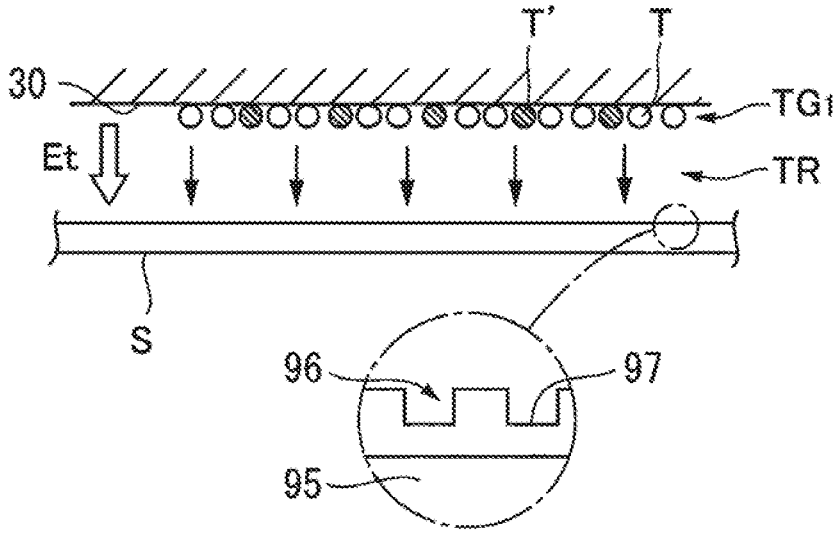
FIG. 4C is a diagram schematically showing a transfer operation in a secondary transfer region of the secondary transfer device.

Further, as shown in FIG. 4C, in a secondary transfer region TR of a secondary transfer device 40, a toner image on the intermediate transfer body 30 is transferred to the sheet S by a secondary transfer electric field Et between the transfer roller 41 and the tension roller 34 facing the transfer roller 41.

At this time, when the sheet S is the embossed paper, as shown in FIG. 4C, a part of the secondary transfer electric field Et tends to be abnormally discharged in a region of a concave portion 97 of an embossment 96 due to the presence of the embossment 96 on a surface of a medium body 95, and in particular, the deteriorated toner T' having a high adhesive force to the intermediate transfer body 30 is hardly transferred to the concave portion 97 of the sheet S. When the sheet S is the rough paper, since the density of paper fiber (not shown) in the medium body 95 is low, minute voids (not shown) exist in the medium body 95, and abnormal discharge easily occurs in the minute voids, and in particular, the deteriorated toner T' having the high adhesive force to the intermediate transfer body 30 is hardly transferred to the sheet S.

As described above, when the sheet S is the embossed paper or the rough paper, a toner image TG1 (including the deteriorated toner T') carried on the intermediate transfer body 30 is hardly transferred to the sheet S in the secondary transfer region TR, which may lead to deterioration of image quality such as the white spot.

<Relationship Between Toner Deterioration Level and Transfer Unevenness for Sheet Type>

Figure 5A:
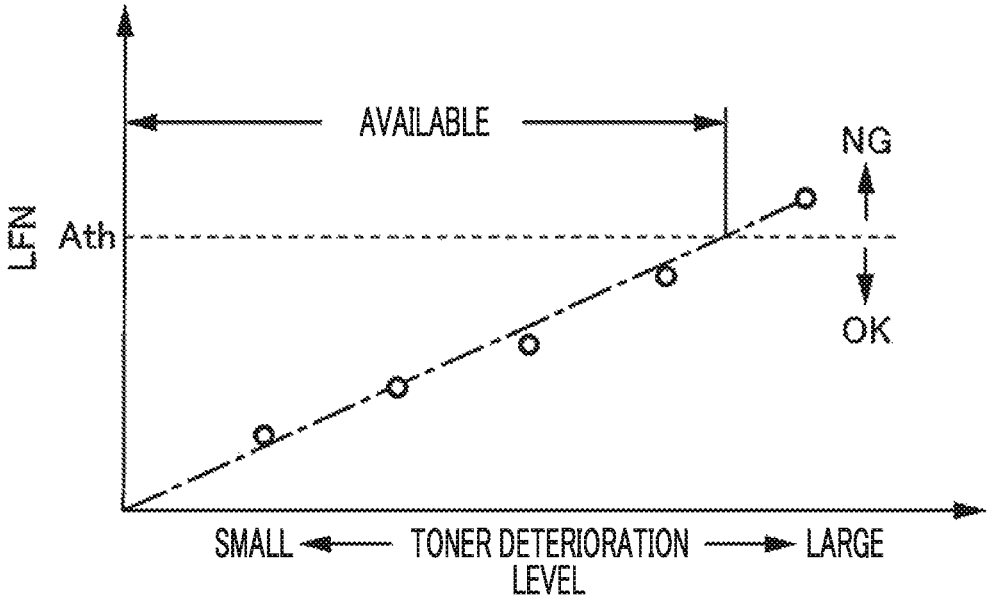
FIG. 5A is a diagram schematically showing a relationship between a toner deterioration level and a transfer unevenness of a transferred image under a condition that an image is transferred to plain paper.
Figure 5B:
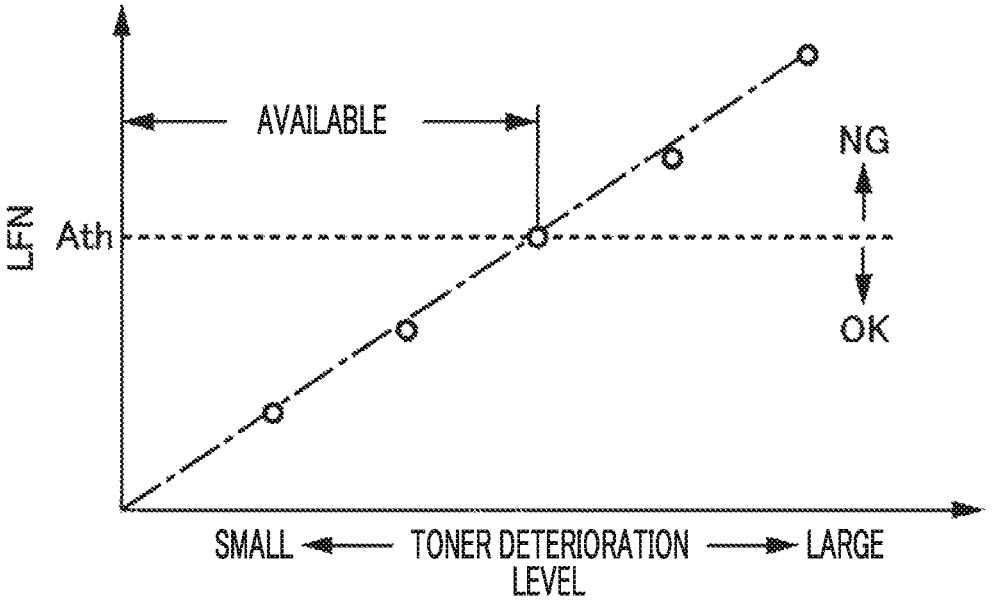
FIG. 5B is a diagram schematically showing the relationship between the toner deterioration level and the transfer unevenness under a condition that an image is transferred to the embossed paper/rough paper.

Next, the relationship between the toner deterioration level and the transfer unevenness (in this example, low-frequency noise (hereinafter, which may be abbreviated as LFN) is used as an example of a parameter for evaluating the quality of the transferred image) with respect to the sheet type is studied, and results shown in FIGS. 5A and 5B is obtained.

FIG. 5A shows the relationship between the toner deterioration level and the LFN with respect to the plain paper.

In the figure, a horizontal axis represents the toner deterioration level at which a level value increases as a degree of embedment of the external additive of the toner particles increases, and a vertical axis represents LFN as an index for evaluating the quality of the transferred image. In the figure, Ath indicates an upper limit allowable value at which the quality of the transferred image is good.

According to the figure, when the sheet S is the plain paper, it is understood that the LFN is an allowable value Ath or less even if the toner deterioration level is large to some extent, and it is understood that the quality of the transferred image is maintained when the toner image using the toner is transferred to the sheet S even if the toner forming the toner image contains deteriorated toner having a large toner deterioration level to some extent.

FIG. 5B shows the relationship between the toner deterioration level and the LFN for the embossed paper (or rough paper). The horizontal axis and the vertical axis are the same as those in FIG. 5A.

According to the figure, when the sheet S is the embossed paper or the rough paper, it is understood that the LFN is the allowable value Ath or less under a condition that the toner deterioration level is not advanced too much, and when the toner forming the toner image contains the deteriorated toner having the large toner deterioration level to some extent, it is understood that the deterioration of the quality of the transferred image such as the white spot occurs when the toner image using the toner is transferred to the sheet S such as the embossed paper. That is, it is understood that sensitivity to the deterioration of the quality of the transferred image due to the deteriorated toner is higher in the sheet having the low transferability such as the embossed paper than in the plain paper.

—Improvement of Quality of Transferred Image—

Figure 4D:
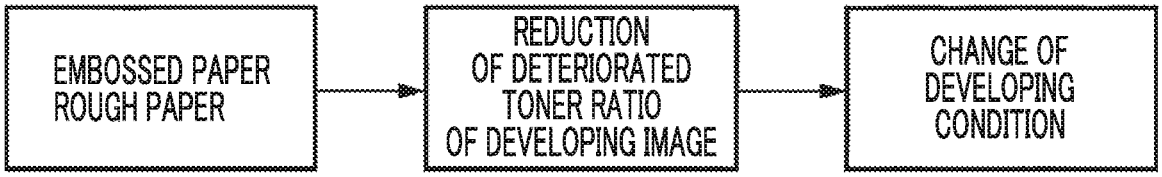
FIG. 4D is a diagram showing a reason for changing a developing condition when a sheet serving as a medium is embossed paper or rough paper.

In view of the facts shown in FIGS. 4A to 4C and FIGS. 5A to 5B, the inventors of the present disclosure predicted that the factor of deterioration of image quality is in the presence of the deteriorated toner T' when the sheet S is the sheet having the low transferability such as the embossed paper or the rough paper, and obtained an idea that the developing condition may be changed so as to reduce the ratio of the deteriorated toner T' of the developing image (corresponding to the toner image formed by the development) as shown in FIG. 4D when the sheet S is the sheet having the low transferability.

In the present example, a first image forming mode IM1 is executed when the sheet S is the plain paper, and a second image forming mode IM2 is executed when the sheet S is the sheet having the low transferability such as the embossed paper.

Figure 6:
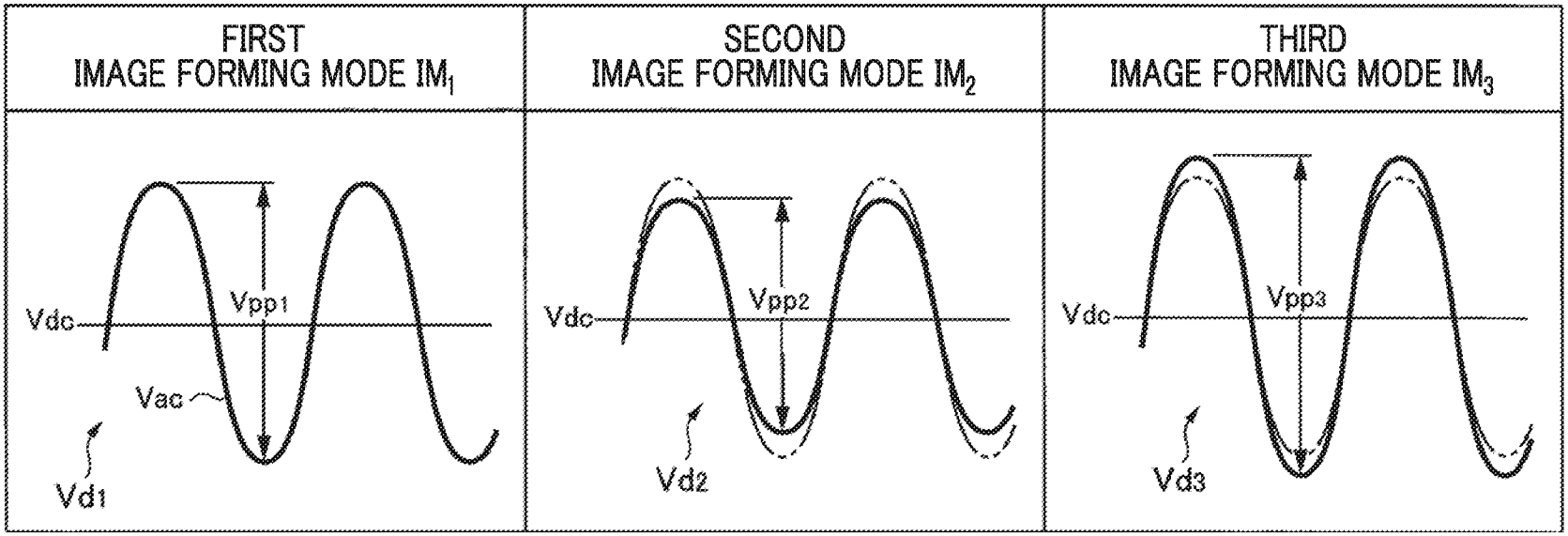
FIG. 6 is a diagram schematically showing first to third image forming modes used in the exemplary embodiment 1 or an exemplary embodiment 2.

In the present example, in the first image forming mode IM1, as shown in FIG. 6, a technique is adopted in which the developing condition of the developing device 24 is set to the first control mode, that is, the peak-to-peak voltage Vpp of the AC component Vac of the developing voltage Vd is set to Vpp1, and in the second image forming mode IM2, as shown in FIG. 6, the developing condition of the developing device 24 is set to the second control mode, that is, the peak-to-peak voltage Vpp of the AC component Vac of the developing voltage Vd is set to Vpp2 (Vpp2<Vpp1).

Here, when setting Vpp1 and Vpp2, the optimum range may be selected through experiments or the like so that the quality of the transferred image falls within an allowable range in consideration of the specifications of the respective image forming apparatuses.

—Control System of Image Forming Apparatus—

As shown in FIG. 3, the control system of the image forming apparatus has a microcomputer-based control device 110, including, for example, a CPU, a RAM, a ROM, and input/output ports, and an image forming sequence program (for example, see FIG. 7) is installed in the ROM of the control device 110 in advance. In addition, the control device 110 is connected with the sheet type specifying unit 111 and the sheet type determination unit 112, and also the developing power supply 76 of the developing device 24 and the power supply for transfer 43 of the secondary transfer device 40 are connected to the control device 110. Accordingly, the CPU fetches sheet information to be used from the sheet type specifying unit 111 and the sheet type determination unit 112, and also executes the above-described image forming sequence program to send a control signal to the developing power supply 76 of the developing device 24 and the like.

—Operation of Image Forming Apparatus—

In the present exemplary embodiment, when starting the image forming sequence by the image forming apparatus, as shown in FIG. 2, after selecting the sheet S to be used, a start switch (not shown in the figure) may be turned on.

At this time, each color component toner image formed by each image forming unit 20 is primarily transferred to the intermediate transfer body 30 by the primary transfer device 25, and secondarily transferred to the sheet S by the secondary transfer device 40, and then the secondarily transferred sheet S is discharged to a sheet discharge receiver (not shown) after undergoing a fixing process by the fixing device 50.

Figure 7:
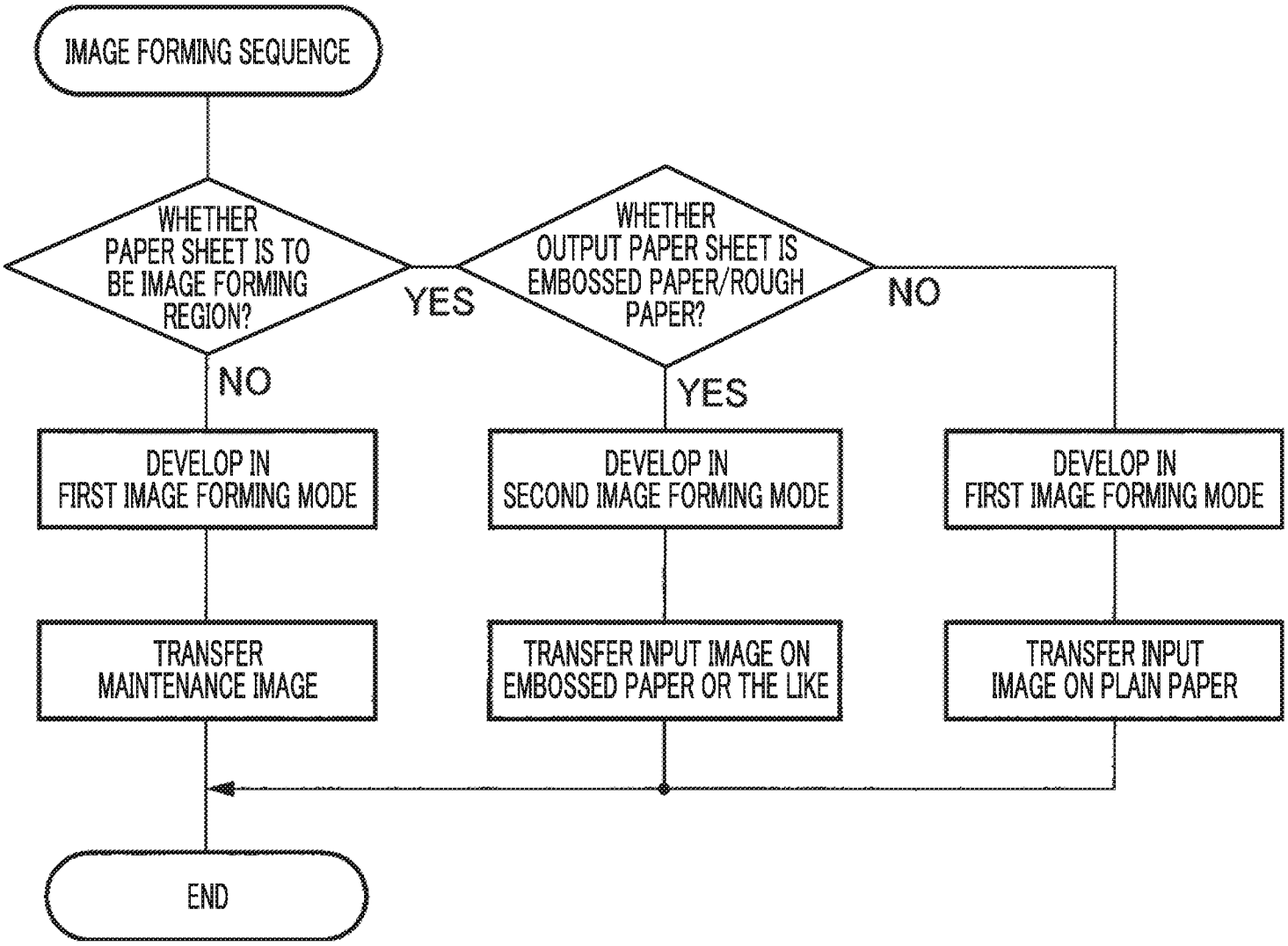
FIG. 7 is a flowchart of an image forming sequence used in the image forming apparatus according to the exemplary embodiment 1.

In the present example, as shown in FIG. 3 and FIG. 7, the control device 110 first determines whether or not the sheet S is to be an image forming region. That is, in this step, it is determined whether the mode is a normal printing mode or a maintenance mode. In the normal printing mode, an image is printed on the sheet S and output. In the maintenance mode, a maintenance image such as a band image serving as a process control image is formed for maintenance of the image forming apparatus, and a density of the maintenance image is detected by a density detector which is not shown in the figure (for example, the density detector is provided around the intermediate transfer body 30) without an image being printed on the sheet S.

In the case of the normal printing mode, it is checked whether or not the sheet S to be used is the embossed paper/rough paper based on signals from the sheet type specifying unit 111 and the sheet type determination unit 112.

At this time, when the control device 110 determines that the sheet S is the plain paper, the control device 110 executes the first image forming mode IM1. That is, the developing condition of the developing device 24 is set to the first control mode, and the peak-to-peak voltage Vpp of the AC component Vac of the developing voltage Vd is set to Vpp1.

Figure 8B:
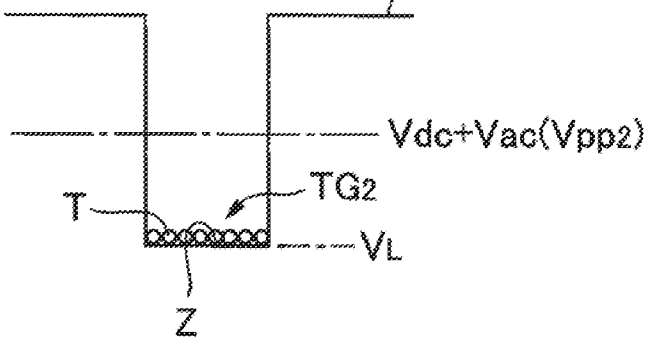
FIG. 8B is a diagram schematically showing a developing operation in the second image forming mode.
Figure 8A:
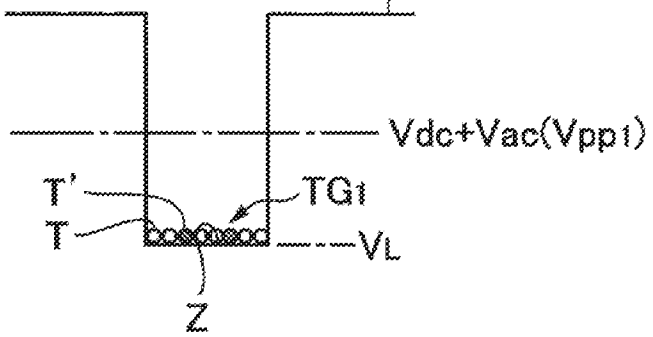
FIG. 8A is a diagram schematically showing a developing operation in the first image forming mode.

Focusing on the developing operation in the first image forming mode, as shown in FIG. 8A, the developing voltage Vd is obtained by superimposing the AC component Vac on the DC component Vdc (Vpp1), and the toner image TG1 obtained by developing an electrostatic latent image Z on the photoconductor 21 by the developing device 24 contains a certain amount of the deteriorated toner T' in addition to the normal toner T that is not deteriorated.

Figure 8D:
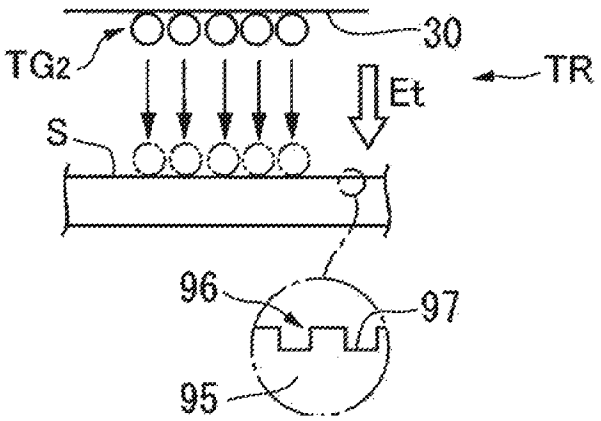
FIG. 8D is a diagram schematically showing the secondary transfer operation in the second image forming mode.
Figure 8C:
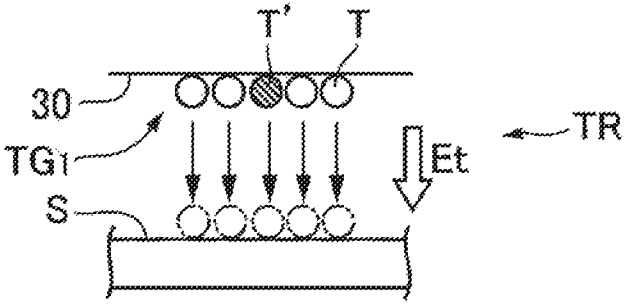
FIG. 8C is a diagram schematically showing a secondary transfer operation in the first image forming mode.

In this state, as the transfer operation in the first image forming mode, as shown in FIG. 8C, when the toner image TG1 reaches the secondary transfer region TR, the toner image TG1 carried on the intermediate transfer body 30 by the secondary transfer electric field Et is transferred to the sheet S. At this time, although the toner image TG1 transferred to the sheet S made of the plain paper also contains a certain amount of the deteriorated toner T', in the sheet S made of the plain paper, since the sensitivity to the deterioration of the quality of the transferred image due to the deteriorated toner T' is low, the deterioration of the quality of the transferred image such as the white spot does not occur.

On the other hand, when the control device 110 determines that the sheet S is the embossed paper/rough paper, the control device 110 executes the second image forming mode IM2. That is, the developing condition of the developing device 24 is set to the second control mode, and the peak-to-peak voltage Vpp of the AC component Vac of the developing voltage Vd is set to Vpp2 (Vpp2<Vpp1).

Focusing on the developing operation in the second image forming mode, as shown in FIG. 8B, the developing voltage Vd is obtained by superimposing the AC component Vac on the DC component Vdc (Vpp2<Vpp1), and the toner image TG2 obtained by developing the electrostatic latent image Z on the photoconductor 21 by the developing device 24 contains a lot of the normal toner T that is not deteriorated, and hardly contains the deteriorated toner T'.

In this state, as the transfer operation in the second image forming mode, as shown in FIG. 8D, when the toner image TG2 reaches the secondary transfer region TR, the toner image TG2 carried on the intermediate transfer body 30 by the secondary transfer electric field Et is transferred to the sheet S. At this time, the toner image TG2 transferred to the sheet S such as the embossed paper hardly contains the deteriorated toner T', and contains a lot of the normal toner T that is not deteriorated. In the present example, although the sheet S such as the embossed paper has a high sensitivity to the deterioration of the quality of the transferred image due to the deteriorated toner T', the toner image TG2 hardly contains the deteriorated toner T', so that the deterioration of the quality of the transferred image such as the white spot does not occur.

<Maintenance Mode>

In the present example, the maintenance mode may be executed at a timing different from the normal printing mode, or may be executed in parallel while the normal printing mode of the continuous number of sheets is being executed. In particular, in the latter case, the maintenance image is formed between the inter-image regions corresponding to the sheets S on the intermediate transfer body 30.

At this time, in the present example, since the first image forming mode IM1 is executed as shown in FIG. 7, the toner image TG1 containing the deteriorated toner T' is formed on the photoconductor 21 as shown in FIG. 8A. However, the toner image TG1 is cleaned by the intermediate transfer body cleaning device 35 after a density of the toner image TG1 is detected by the density detector (not shown in the figure).

Therefore, in the present example, since the toner image TG1 formed in the maintenance mode is cleaned by the intermediate transfer body cleaning device 35 without being transferred to the sheet S. Accordingly, even if the toner image TG1 contains the deteriorated toner T', there is no concern that the toner image TG1 leads to the factor of the deterioration of the quality of the transferred image.

In the present example, since the first image forming mode IM1 is adopted instead of the second image forming mode IM2 in the maintenance mode, the discharge amount of the deteriorated toner T' staying in the developing device 24 is larger than that in the case of adopting the second image forming mode IM2. Accordingly, a situation in which the deteriorated toner T' unnecessarily stays in the developing device 24 is prevented.

Modified Exemplary Embodiment 1-1

In the present exemplary embodiment, as the second image forming mode IM2, the peak-to-peak voltage Vpp of the AC component Vac of the developing voltage Vd is changed to Vpp2 (<Vpp1) as the developing condition of the developing device 24. However, not limited to the peak-to-peak voltage Vpp, a frequency Vf of the AC component Vac may be changed in addition to the peak-to-peak voltage Vpp, or only the frequency Vf of the AC component Vac may be changed instead of the peak-to-peak voltage Vpp, as long as it satisfies a viewpoint of reducing the developing property more than the first image forming mode IM1.

Modified Exemplary Embodiment 1-2

Further, in the present exemplary embodiment, in the second image forming mode IM2, the peak-to-peak voltage Vpp of the AC component Vac of the developing voltage Vd is changed as the developing condition of the developing device 24. However, not limited to the peak-to-peak voltage Vpp, it may be changed together with the DC component Vdc of the developing voltage Vd. Here, when changing the DC component Vdc of the developing voltage Vd together, the peak-to-peak voltage Vpp2 becomes smaller than the peak-to-peak voltage Vpp1, so that the developing property is reduced to that extent. However, by changing the DC component Vdc so as to increase an absolute value of a difference between the DC component Vdc of the developing voltage Vd and an image portion potential VL, a reduction in a density of the developed image is prevented, and density characteristics of the toner image may be maintained favorably.

Modified Exemplary Embodiment 1-3

In the present exemplary embodiment, as shown in FIG. 7, a method of changing the developing condition of the developing device 24 is adopted in the second image forming mode IM2 as compared with the first image forming mode IM1, and the transfer condition of the power supply for transfer 43 of the secondary transfer device 40 is handled in the same manner as in the first image forming mode IM1. However, not limited to this, the transfer voltage Vt of the power supply for transfer 43 may be changed in accordance with the sheet type, and the transfer condition suitable for the sheet type (various parameters of the sheet S such as volume resistivity) may be set.

Exemplary Embodiment 2

Figure 9:
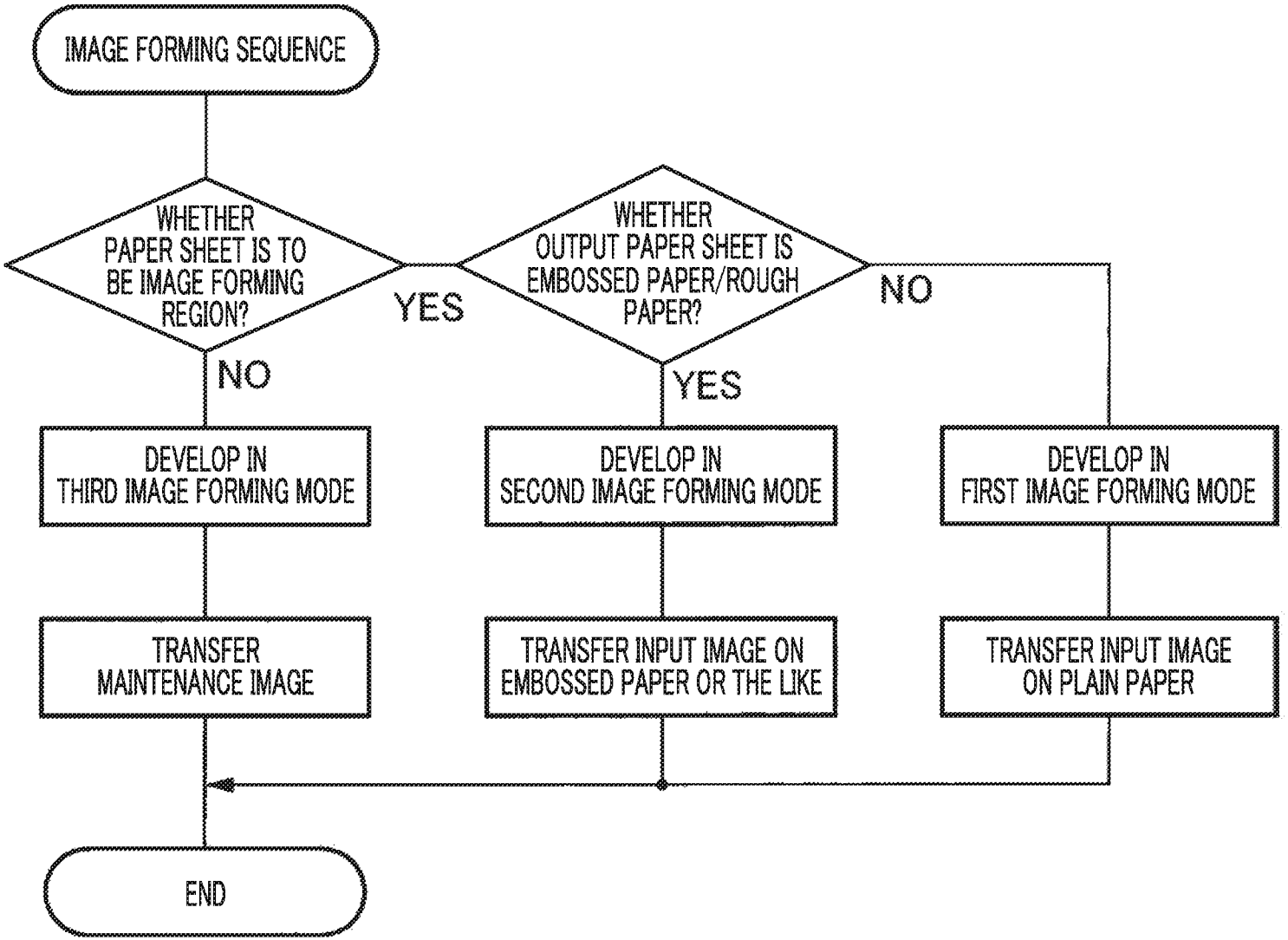
FIG. 9 is a flowchart of an image forming sequence used in the image forming apparatus according to the exemplary embodiment 2.

FIG. 9 is a flowchart of an image forming sequence by the image forming apparatus according to an exemplary embodiment 2.

In the figure, the image forming sequence of the image forming apparatus is substantially the same as the exemplary embodiment 1 in the first image forming mode IM1 and the second image forming mode IM2 adopted in a normal image forming mode, but the maintenance mode has a configuration different from the exemplary embodiment 1.

In the present example, as shown in FIG. 6, the image forming sequence program includes a third image forming mode IM3 for controlling the peak-to-peak voltage Vpp of the AC component Vac of the developing voltage Vd to be Vpp3 having higher peak-to-peak voltage than the peak-to-peak voltage Vpp1 in the first image forming mode IM1, and the control device 110 executes the third image forming mode IM3 in the "maintenance mode" in which an image is not formed on the sheet S.

Therefore, in the present example, it is possible to further promote the discharge of the deteriorated toner T' in the developing device 24 as compared with the case of executing the first image forming mode IM1 in the exemplary embodiment 1, and it is possible to further improve the situation in which the deteriorated toner T' continues to stay in the developing device 24.

EXAMPLES

Example 1

Example 1 shows specific examples of the following items in implementing the image forming apparatus according to the exemplary embodiment 1.

Selection of the "sheet having low-transferability"

Analysis of the deteriorated toner, which is a factor of the deterioration of image quality for the "sheet having low transferability"

Example of changing the developing condition in the second image forming mode

—Selection of "Sheet Having Low Transferability"—

The first image forming mode IM1 is executed on each of the following sheets having different smoothness and different density, and the quality of the transferred image is evaluated.

Sheet Type

SAGAN GA (210 kg/natural)

SAGAN GA (210 kg/dark gray)

FIRST VINTAGE (172 kg/beige)

FIRST VINTAGE (172 kg/dark gray)

FIRST VINTAGE (103 kg/beige)

FIRST VINTAGE (103 kg/dark gray)

MODERN CRAFT (197.5 kg/brown)

ARCOPRINT MILK (300 gsm)

KENRAN (264 kg/ultramarine)

KENRAN (360 kg/light cream)

KISHU COLORED WOOD-FREE PAPER (ultra-thick mouth/204 gsm/cream)

KISHU COLORED WOOD-FREE PAPER (Ultra-thick mouth/204 gsm/blue)

KISHU COLORED WOOD-FREE PAPER (light mouth/60.5 gsm/cream)

AIRUS (93 gsm)

Figure 10:
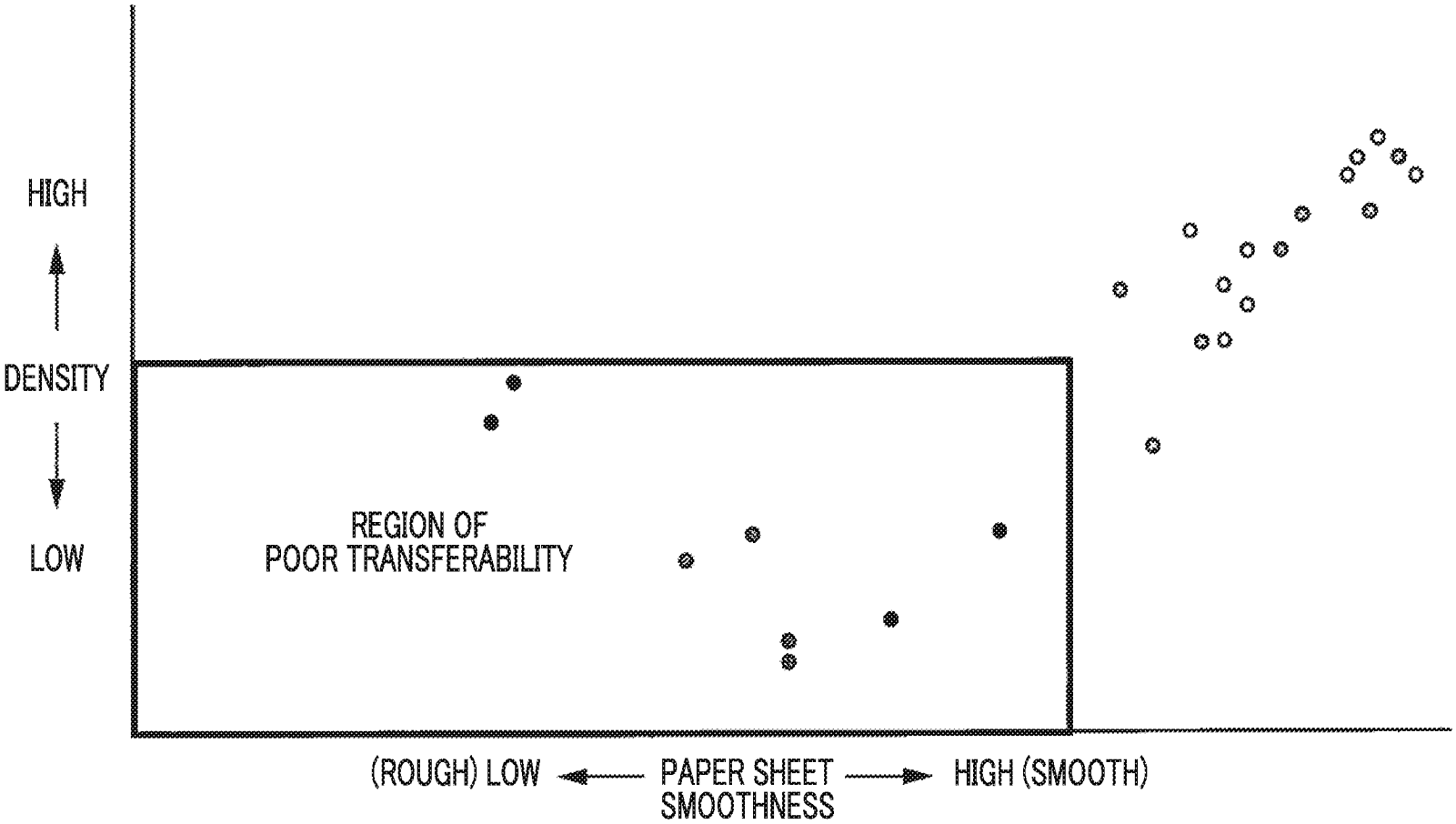
FIG. 10 is a diagram showing an example obtained by studying a relationship among smoothness, density, and a transferability of various sheets used in Example 1.

FIG. 10 shows the result of executing the first image forming mode IM1 for each sheet.

According to the figure, for the sheets having characteristics within a range surrounded by a rectangular frame in FIG. 10, the image quality deterioration such as the white spot is observed and the transferability is poor, whereas for the sheets having the characteristics outside the range surrounded by the rectangular frame in FIG. 10, no image quality deterioration such as the white spot is observed. Therefore, it is understood that the sheets having the characteristics within the range surrounded by the rectangular frame in FIG. 10 is regarded as the "sheet having the low transferability", and, for example, the sheets having surface smoothness lower (rough) than a predetermined threshold value and the sheets having density lower than a predetermined threshold value may be grouped as the "sheet having low transferability".

—Analysis of Deteriorated Toner that is Factor of Deterioration of Image Quality for "Sheet Having Low Transferability"—

Figure 11:
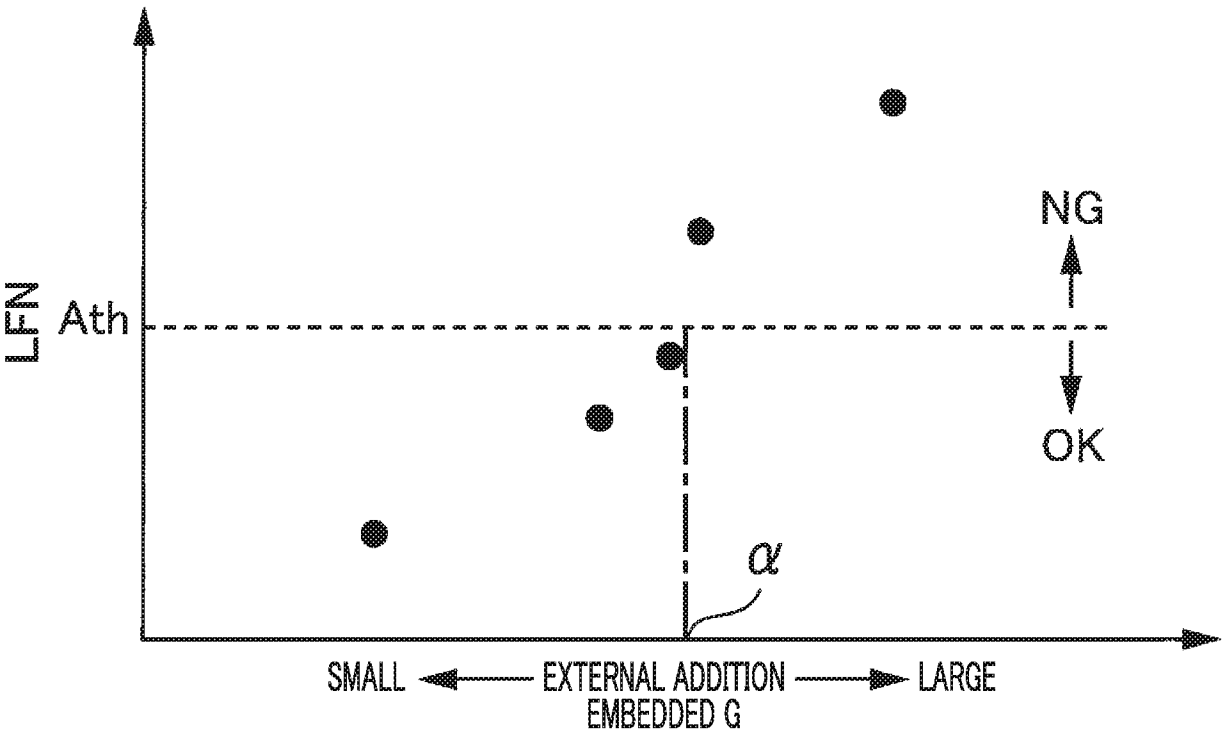
FIG. 11 is a diagram showing an example obtained by studying an image sensitivity of the embossed paper used in Example 1 with respect to an external addition embedment.

When an image transfer operation is performed on the embossed paper (for example, boss snow of 186 gsm black) belonging to the "sheet having low transferability" by using a deteriorated toner of a different external addition embedded grade, the result shown in FIG. 11 is obtained.

In the figure, a horizontal axis represents the external addition embedded grade (denoted by "external addition embedded G" in the figure), and a numerical value increases as an embedded degree of the toner advances, for the toners having different embedment degree of the external additive, and when the image is produced by the toner having different external addition embedded grade, toner groups having different external addition embedded G are produced in the developing device by changing the continuous operation time of the agitation and transport of the developer in the developing device, and the developing operation in the first image forming mode is executed by using the developing device including the toner group of each external addition embedded G.

In a vertical axis in the figure, a half-tone image of 50% Cin is prepared with a black toner as the transferred image, and a degree of transfer unevenness due to the toner of the external addition embedded G selected in advance is evaluated by low-frequency noise (LFN: abbreviation for Low-Frequency Noise) as an example of an evaluation parameter of the quality of the transferred image.

According to the figure, if the external addition embedded grade is a threshold value a or less, it is understood that the LFN is the allowable value Ath or less, and if the toner in a vicinity where the external addition embedded grade exceeds the threshold value a is used, it is understood that the LFN exceeds the allowable value Ath.

In this example, when the toner having the external addition embedded grade exceeding the threshold value a is used, it becomes difficult for the toner to be transferred as the deteriorated toner, which is presumed to be the factor of the image quality deterioration such as the white spot. Therefore, it is necessary to change the developing condition so as not to contain the deteriorated toner as the transferred image as much as possible for the "sheets having low transferability", and it is understood that it is effective to adopt the second image forming mode IM2 different from the first image forming mode IM1.

—Example of Changing Developing Condition in Second Image Forming Mode—

Figure 12:
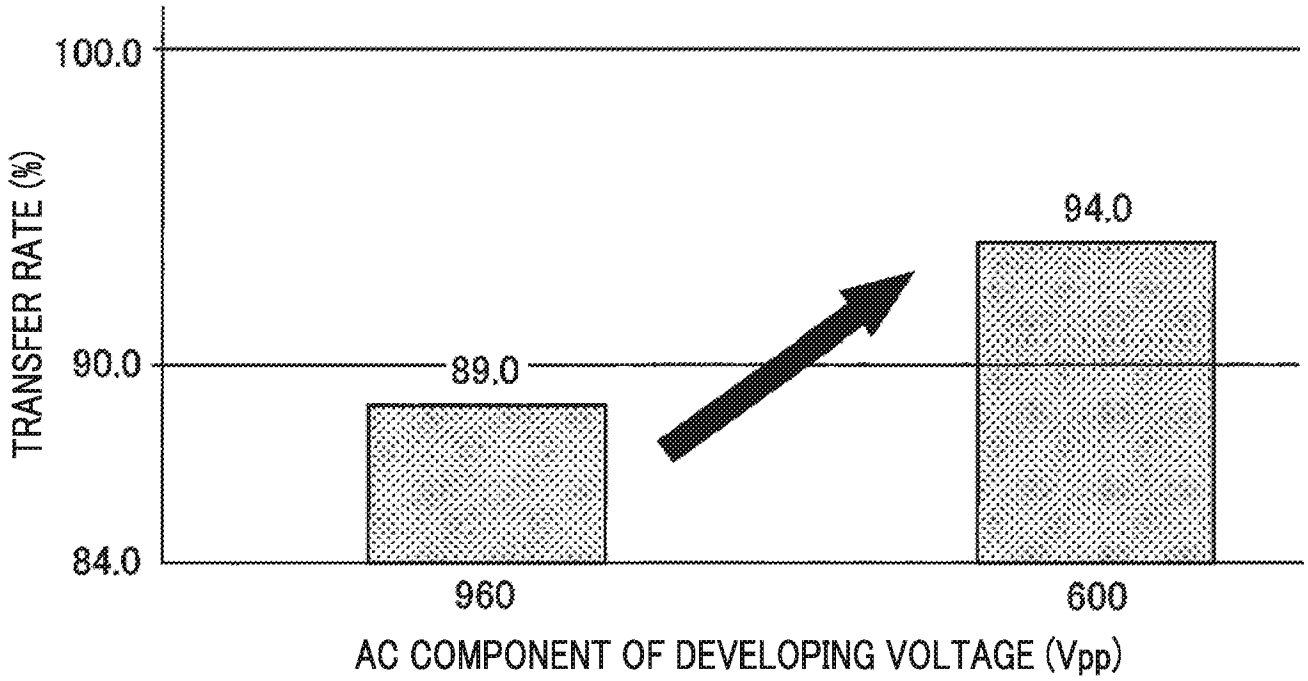
FIG. 12 is a diagram showing an example of transfer rate sensitivity when an AC component of a developing voltage is changed in Example 1.

In the present example, studied is a change of a transfer rate (%) when the peak-to-peak voltage Vpp of the AC component Vac of the developing voltage Vd is changed as the developing condition in the first image forming mode and the second image forming mode, and results shown in FIG. 12 is obtained.

In the figure, in the first image forming mode IM1, when the peak-to-peak voltage Vpp is set to 960V as the developing condition, the transfer rate is 89%. On the other hand, in the second image forming mode IM2, when the peak-to-peak voltage Vpp is set to 600V as the developing condition, the transfer rate rose to 94% and the transfer performance is confirmed to be improved.

From this result, it is understood that it is effective to execute the second image forming mode IM2 different from the first image forming mode IM1 for the "sheet having low transferability".

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier configured to carry an image;

a developing unit comprising a developer carrying unit that faces the image carrier, wherein the developing unit is configured to apply a developing voltage in which an AC component is superimposed on a DC component between the image carrier and the developer carrying unit so as to develop an electrostatic latent image formed on the image carrier with a developer carried by the developer carrying unit;

a transfer unit configured to electrostatically transfer the image, which is carried on the image carrier and developed by the developing unit, onto media of different types; and a development controller configured to control a developing operation of the developing unit, wherein the development controller is configured to control:

a first control mode for a first medium; and a second control mode for a second medium having a lower transferability than the first medium, wherein the second medium is embossed paper, wherein in the first control mode, the developing unit applies the developing voltage according to a predetermined first developing condition, and wherein in the second control mode, the developing unit applies the developing voltage according to a second developing condition in which a developing property is reduced as compared with the first developing condition.

2. The image forming apparatus according to claim 1, wherein the second medium is lower in information on surface smoothness than the first medium.

3. The image forming apparatus according to claim 2, wherein the development controller is configured to control a third control mode for controlling a peak-to-peak voltage of the AC component of the developing voltage to be higher than a peak-to-peak voltage in the first control mode, and wherein the development controller is configured to execute the third control mode when forming an image that is not formed on the medium.

4. The image forming apparatus according to claim 1, wherein the second medium is lower in information on density than the first medium.

5. The image forming apparatus according to claim 4, wherein the development controller is configured to control a third control mode for controlling a peak-to-peak voltage of the AC component of the developing voltage to be higher than a peak-to-peak voltage in the first control mode, and wherein the development controller is configured to execute the third control mode when forming an image that is not formed on the medium.

6. The image forming apparatus according to claim 4, wherein the information on the density is information on air permeability.

7. The image forming apparatus according to claim 6, wherein the development controller is configured to control a third control mode for controlling a peak-to-peak voltage of the AC component of the developing voltage to be higher than a peak-to-peak voltage in the first control mode, and wherein the development controller is configured to execute the third control mode when forming an image that is not formed on the medium.

8. The image forming apparatus according to claim 1, wherein the development controller comprises a selector configured to select either one of the first control mode and the second control mode based on a type of the medium.

9. The image forming apparatus according to claim 8, wherein the selector is configured to select the first control mode if the medium is not the second medium, and to select the second control mode if the medium is the second medium.

10. The image forming apparatus according to claim 9, wherein the development controller is configured to control a third control mode for controlling a peak-to-peak voltage of the AC component of the developing voltage to be higher than a peak-to-peak voltage in the first control mode, and wherein the development controller is configured to execute the third control mode when forming an image that is not formed on the medium.

11. The image forming apparatus according to claim 8, further comprising:

a determination unit configured to determine whether or not the medium is the second medium, wherein the selector is configured to select the first control mode or the second control mode based on a determination signal from the determination unit.

12. The image forming apparatus according to claim 11, wherein the development controller is configured to control a third control mode for controlling a peak-to-peak voltage of the AC component of the developing voltage to be higher than a peak-to-peak voltage in the first control mode, and wherein the development controller is configured to execute the third control mode when forming an image that is not formed on the medium.

13. The image forming apparatus according to claim 8, wherein the development controller is configured to control a third control mode for controlling a peak-to-peak voltage of the AC component of the developing voltage to be higher than a peak-to-peak voltage in the first control mode, and wherein the development controller is configured to execute the third control mode when forming an image that is not formed on the medium.

14. The image forming apparatus according to claim 1, wherein the first control mode and the second control mode use a peak-to-peak voltage of the AC component of the developing voltage as a developing condition, and control the peak-to-peak voltage in the second control mode to be lower than the peak-to-peak voltage in the first control mode.

15. The image forming apparatus according to claim 14, wherein the development controller is configured to control a third control mode for controlling a peak-to-peak voltage of the AC component of the developing voltage to be higher than a peak-to-peak voltage in the first control mode, and wherein the development controller is configured to execute the third control mode when forming an image that is not formed on the medium.

16. The image forming apparatus according to claim 1, wherein the second control mode controls the DC component of the developing voltage in addition to a peak-to-peak voltage of the AC component of the developing voltage.

17. The image forming apparatus according to claim 1, wherein the development controller is configured to execute the first control mode when forming an image that is not formed on the medium.

18. The image forming apparatus according to claim 1, wherein the development controller is configured to control a third control mode for controlling a peak-to-peak voltage of the AC component of the developing voltage to be higher than a peak-to-peak voltage in the first control mode, and wherein the development controller is configured to execute the third control mode when forming an image that is not formed on the medium.

19. The image forming apparatus according to claim 1, further comprising:

a transfer controller configured to perform control such that a transfer condition of the transfer unit is changed when the development controller executes the first control mode or the second control mode.

20. An image forming apparatus comprising:

an image carrying means for carrying an image;

a developing means comprising developer carrying means that faces the image carrying means, the developing means for applying a developing voltage in which an AC component is superimposed on a DC component between the image carrying means and the developer carrying means so as to develop an electrostatic latent image formed on the image carrying means with a developer carried by the developer carrying means;

a transfer means for electrostatically transferring the image, which is carried on the image carrying means and developed by the developing means, onto media of different types; and a development control means for controlling a developing operation of the developing means, wherein the development control means is for controlling:

a first control mode for a first medium, and a second control mode for a second medium having a lower transferability than the first medium, wherein the second medium is embossed paper, wherein in the first control mode, the developing means applies the developing voltage according to a predetermined first developing condition, and wherein in the second control mode, the developing means applies the developing voltage according to a second developing condition in which a developing property is reduced as compared with the first developing condition.

* * * * *